US010962212B2

(12) United States Patent
Laso

(10) Patent No.: US 10,962,212 B2
(45) Date of Patent: Mar. 30, 2021

(54) RECESSED LIGHTING FIXTURE

(71) Applicant: SIGNIFY HOLDING B.V., Eindhoven (NL)

(72) Inventor: Jose Antonio Laso, Newnan, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/570,694

(22) Filed: Sep. 13, 2019

(65) Prior Publication Data

US 2020/0088393 A1 Mar. 19, 2020

Related U.S. Application Data

(60) Provisional application No. 62/731,673, filed on Sep. 14, 2018.

(51) Int. Cl.

| | |
|---|---|
| ***F21V 23/00*** | (2015.01) |
| ***F21S 8/02*** | (2006.01) |
| ***F21S 9/00*** | (2006.01) |
| ***F21S 8/04*** | (2006.01) |

(52) U.S. Cl.

CPC ..... *F21V 23/002* (2013.01); *F21S 8/026* (2013.01); *F21V 23/009* (2013.01); *F21S 8/046* (2013.01); *F21S 9/00* (2013.01)

(58) Field of Classification Search

CPC . F21K 9/278; F21S 8/026; F21S 8/046; F21S 8/06; F21V 21/005; F21V 21/04; F21V 21/041; F21V 23/001; F21V 23/002; F21V 23/005; F21V 23/009

See application file for complete search history.

(56) References Cited

U.S. PATENT DOCUMENTS

| | | | | |
|---|---|---|---|---|
| 6,871,981 | B2 * | 3/2005 | Alexanderson | F21V 29/74 362/294 |
| 8,197,079 | B2 | 6/2012 | Ruud et al. | |
| 8,419,223 | B2 * | 4/2013 | Withers | F21V 19/008 362/294 |
| 8,616,720 | B2 | 12/2013 | Carney et al. | |
| 9,285,085 | B2 * | 3/2016 | Carney | F21S 2/005 |
| 9,328,883 | B1 | 5/2016 | Mangiaracina | |
| 10,193,351 | B2 | 1/2019 | Andrews et al. | |
| 10,378,742 | B1 * | 8/2019 | Rao | F21S 9/00 |
| 10,455,654 | B1 | 10/2019 | Andrews et al. | |
| 2007/0285921 | A1 * | 12/2007 | Zulim | F21S 2/00 362/240 |
| 2014/0167653 | A1 * | 6/2014 | Chobot | H05B 47/11 315/362 |
| 2017/0023193 | A1 | 1/2017 | Thosteson et al. | |
| 2017/0231058 | A1 * | 8/2017 | Sadwick | A61M 21/02 |

* cited by examiner

*Primary Examiner* — Leah Simone Macchiarolo

(57) ABSTRACT

A driver-less lighting fixture includes a housing designed to be recessed in a ceiling when the driver-less recessed lighting fixture is installed in the ceiling. The driver-less lighting fixture further includes a light source positioned on an ambient side of the housing to provide an illumination light to an area. The driver-less lighting fixture also includes a connector attached to the housing. The light source is electrically coupled to the connector to receive a power from a driver of a second recessed lighting fixture via an electrical cable coupled to the connector. The connector is positioned such that the connector is hidden from view from below the ceiling when the driver-less recessed lighting fixture installed in the ceiling.

16 Claims, 14 Drawing Sheets

RECESSED LIGHTING FIXTURE

CROSS REFERENCE TO RELATED APPLICATIONS

The present application claims priority under 35 U.S.C. Section 119(e) to U.S. Provisional Patent Application No. 62/731,673, filed Sep. 14, 2018 and titled "Lighting Driver," the entire content of which is incorporated herein by reference.

TECHNICAL FIELD

The present disclosure relates generally to lighting solutions, and more particularly, to lighting fixtures with a shared driver and with an ambient side driver.

BACKGROUND

Many buildings use luminaires such as recessed luminaries to provide lighting. Some luminaires may include an electronics compartment that contains a driver (e.g., a light emitting diode (LED) driver) and other components. An electronics compartment including a driver is generally located on the back side (e.g., a plenum side) of a luminaire. The back side of a luminaire is the side of a luminaire facing away from the area (e.g., floor) below the luminaire when the luminaire is installed, for example, in a ceiling. Typically, each luminaire has a dedicated driver to provide power to the light source and other components (e.g., IoT devices) of the luminaire. As drivers become more efficient, a solution that enables a single driver to provide power to light sources and other components of multiple luminaires may be desirable. In some cases, the relatively higher temperature on the back side of installed luminaires may limit the reduction in size and the efficiency of drivers. For example, to counter the effect of the relatively higher temperature on the back side of installed luminaires, additional heat management mechanisms may be required. Thus, solutions that allow the sharing of a single driver among multiple luminaires and that allows for improved heat management of drivers may be desirable.

SUMMARY

The present disclosure relates generally to lighting solutions, and more particularly, to lighting fixtures with a shared driver and with an ambient side driver. In an example embodiment, a driver-less lighting fixture includes a housing designed to be recessed in a ceiling when the driver-less recessed lighting fixture is installed in the ceiling. The driver-less lighting fixture further includes a light source positioned on an ambient side of the housing to provide an illumination light to an area. The driver-less lighting fixture also includes a connector attached to the housing. The light source is electrically coupled to the connector to receive a power from a driver of a second recessed lighting fixture via an electrical cable coupled to the connector. The connector is positioned such that the connector is hidden from view from below the ceiling when the driver-less recessed lighting fixture installed in the ceiling.

In another example embodiment, a system of recessed lighting fixtures includes a first recessed lighting fixture that includes an electronics compartment positioned on a back side of the first recessed lighting fixture. The electronics compartment has a cavity to contain a driver that provides a first power to a light source of the first recessed lighting fixture, where the light source of the first recessed lighting fixture is configured to provide a first illumination light. The system of the recessed lighting fixtures includes a second recessed lighting fixture, where a light source of the second recessed lighting fixture is configured to provide a second illumination light. The system of recessed lighting fixtures also includes an electrical cable electrically connected to a connector of the first recessed lighting fixture and to a connector of the second recessed lighting fixture. The second recessed lighting fixture is designed to receive a second power from the driver via the electrical cable, where the connector of the first recessed lighting fixture and the connector of the second recessed lighting fixture are positioned to be hidden from view from below a ceiling when the driver-less recessed lighting fixture installed in the ceiling.

In another example embodiment, a lighting fixture includes a housing and a light source positioned on an ambient side of the lighting fixture. The lighting fixture further includes a driver positioned on the ambient side of the lighting fixture to provide power to the light source. The lighting fixture also includes an access box at a backside of the lighting fixture to provide a wiring access to the driver from the backside of the lighting fixture.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
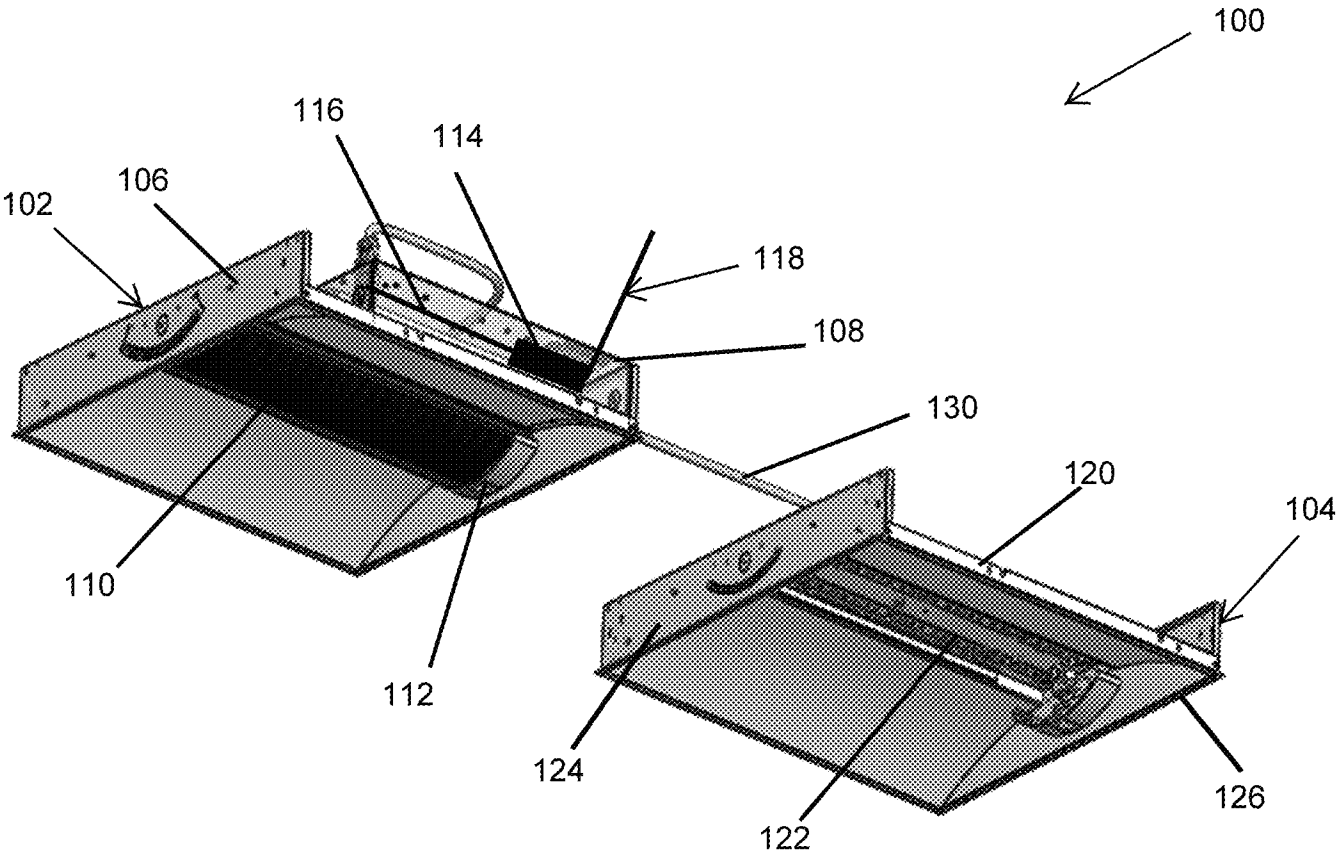
FIG. 1 illustrates a bottom perspective view of a system of lighting fixtures that share a driver according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Figure 2:
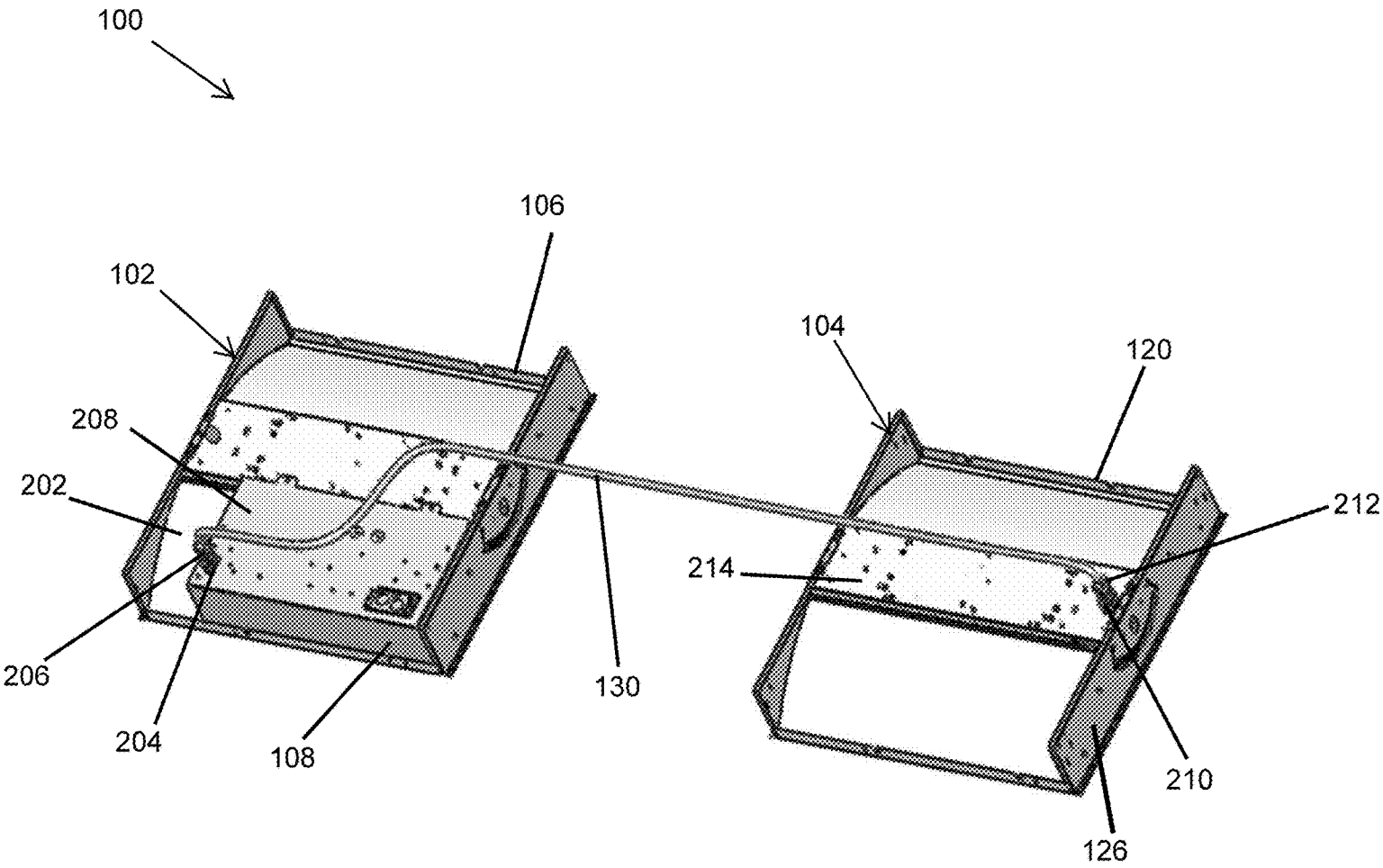
FIG. 2 illustrates a top perspective view of the system of lighting fixtures of FIG. 1 according to an example embodiment.

Turning to the drawings, FIG. 1 illustrates a bottom perspective view of a system 100 of lighting fixtures that share a driver according to an example embodiment, and FIG. 2 illustrates a top perspective view of the system 100 of lighting fixtures of FIG. 1 according to an example embodiment. In some example embodiments, the system 100 includes a lighting fixture 102 and a lighting fixture 104. For example, the lighting fixtures 102, 104 may be recessed luminaires. To illustrate, the lighting fixtures 102, 104 may be recessed behind a ceiling. The lighting fixture 102 includes a housing 106, an electronics compartment 108, and a light source 110 that may include one or more LEDs. The electronics compartment is located on the back side of the lighting fixture 102, and the light source 110 is located on the ambient side of the lighting fixture 102. The lighting fixture 102 may also include a sensor 112 and other IoT devices. The lighting fixture 102 may further include a driver 114 (e.g., an LED driver) that is positioned in the electronics compartment 108. For example, the driver 114 may receive AC power via an electrical cable 118 and, using a transformer or rectifier, may output DC power generated from the AC power. The driver 114 may provide power to the light source 110 as well as the sensor 112. The sensor 112 may provide a detection status signal to the driver 114, and the driver 114 may adjust its output power based on the detection status signal. The lighting fixture 102 may be recessed in a ceiling such that the electronics compartment 108 is behind the ceiling hidden from view from below.

In some example embodiments, the lighting fixture 104 may include a housing 120 and a light source 122 that may include, for example, LEDs that are attached to a circuit board. The housing 120 of the lighting fixture 104 may include end panels 124, 126 and a back panel 214. The housing 120 may also include back covers that are attached to or may be integrally formed with the back panel 214. The light source 122 may be attached to the back panel 214, for example, using fasteners that extend through the circuit board of the light source 122 and the back panel 214. The lighting fixture 104 may not include a driver. That is, the lighting fixture 104 may be a driver-less lighting fixture.

In some example embodiments, the driver 114 of the lighting fixture 102 provides power to the second lighting fixture 104 via an electrical cable 130. To illustrate, the driver 114 is located inside the electronics compartment 108 that is positioned on a back cover 202 of the first lighting fixture 102. An electrical connector 204 may be physically attached to the top cover 208 of the electronics compartment 108 and may be electrically coupled to an electrical cable 116. The electrical cable 116 electrically connects the driver 114 to the connector 204. In some example embodiments, the connector 204 may be a connector that terminates the cable 116. The lighting fixture 102 may be recessed in a ceiling such that the connector is behind the ceiling hidden from view from below.

In some example embodiments, a connector 206 terminating the electrical cable 130 at one end is connected to the connector 204. The cable 130 may be terminated by another electrical connector 212 at the other end. The connector 212 is connected to a connector 210 of the second lighting fixture 104 that may be physically connected to a back panel 214 of the second lighting fixture 104. The connector 210 may be electrically connected to the light source 122 of the second lighting fixture 104 such that power from the driver 114 located at the first lighting fixture 102 can be provided to the light source 122 of the second lighting fixture 104 via the electrical cable 130. The power from the driver 114 that is received via the cable 130 may also be provided to other devices (e.g., a sensor) of the second lighting fixture 104.

In some example embodiments, the cable 130 may include multiple electrical wires for carrying electrical power as well as communication signals between the lighting fixtures 102 and 104. For example, the sensor 112 of the first lighting fixture 102 may provide the detection status signal to the driver 114, and the driver 114 may adjust the power provided to the light source 110 and/or to the light source 122 based on the detection status signal from the sensor 112. As another example, a sensor of the second lighting fixture 104 may provide a status signal to the driver 114 via the cable 130, and the driver 114 may adjust the power provided to the light source 110 and/or to the light source 122 based on the status signal. For example, the sensor 112 may be omitted if a sensor of the second lighting fixture 104 provides adequate sensing coverage. In some example embodiments, the cable 130 may be a Class 2 cable.

By using the driver 114 of the first lighting fixture 102 to provide power to the light sources and other components of both the first lighting fixture 102 and the second lighting fixture 104, an electronics compartment and a dedicated driver can be eliminated from the second lighting fixture 104. By using a status signal from the sensor 112 to adjust the power provided by the driver 114 to the light source 122, a dedicated sensor may be eliminated from the second lighting fixture 104 or a different type of sensor may be included in the second lighting fixture 104.

In some alternative embodiments, the lighting fixtures 102, 104 may be different types of lighting fixtures than shown. In some alternative embodiments, the lighting fixtures may be different types from each other. In some alternative embodiments, the electronics compartment 108 may be located at a different location. In some alternative embodiments, the connectors 204, 210 may be at different locations than shown. In some example embodiments, the lighting fixture 102 and the lighting fixture 104 may be located in different rooms from each other. In some alternative embodiments, the lighting fixtures 102, 104 may each have a different shape than shown without departing from the scope of this disclosure.

Figure 3:
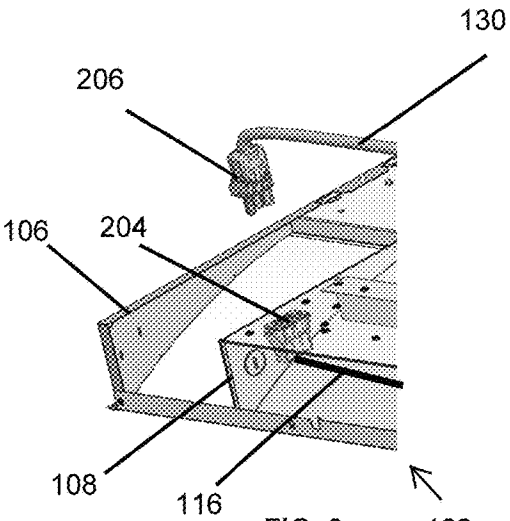
FIG. 3 is a close-up view of a cable connection of the first lighting fixture of FIG. 1 according to an example embodiment.

FIG. 3 is a close-up view of a cable connection of the lighting fixture 102 of the system of FIG. 1 according to an example embodiment. Referring to FIGS. 1-3, in some example embodiments, the connector 204 may be positioned in an opening in the electronics compartment 108 of the first lighting fixture 102. For example, the connector 204 may be positioned in an opening in the top cover 208 of the electronics compartment 108. The connector 204 may be electrically connected to the driver 114 via the electrical cable 116 that may include multiple electrical wires. For example, the driver 114 may provide power to the light source 122 of the second lighting fixture 104 via the cable 116 and may also receive a sensor status signal from a sensor of the second lighting fixture 104 via the cable 116. In some example embodiments, the connector 204 may be a Stucchi connector that receives the mating connector 206 of the cable 130.

Figure 4:
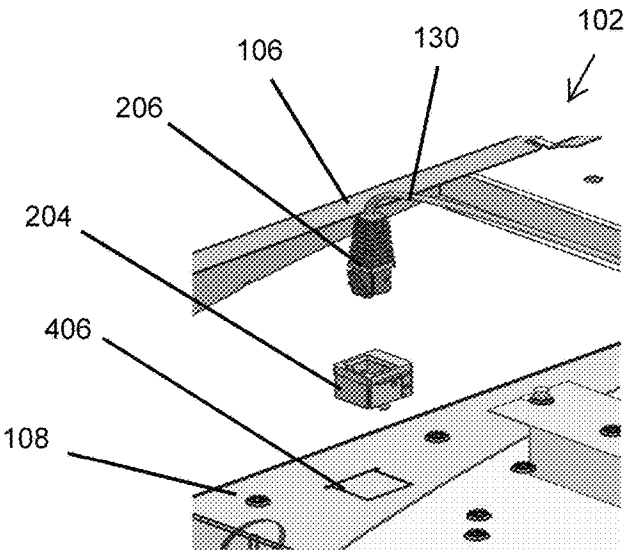
FIG. 4 is a close-up view of a cable connection of the first lighting fixture of FIG. 1 according to another example embodiment.

FIG. 4 is a close-up view of a cable connection of the lighting fixture 102 of FIG. 1 according to another example embodiment. Referring to FIGS. 1, 2, and 4, in some example embodiments, the connector 204 may be an RJ45 socket that is positioned in a hole 406 formed in the electronics compartment 108. The connector 206 may be an RJ45 plug that connects to the RJ45 socket connector 204. For example, the cable 130 may be an Ethernet cable such as a CAT 5e cable. The RJ45 socket connector 204 is connected to the driver 114 that is inside the electronics compartment 108 via the cable 116 that can carry power and sensor signals.

Figure 5:
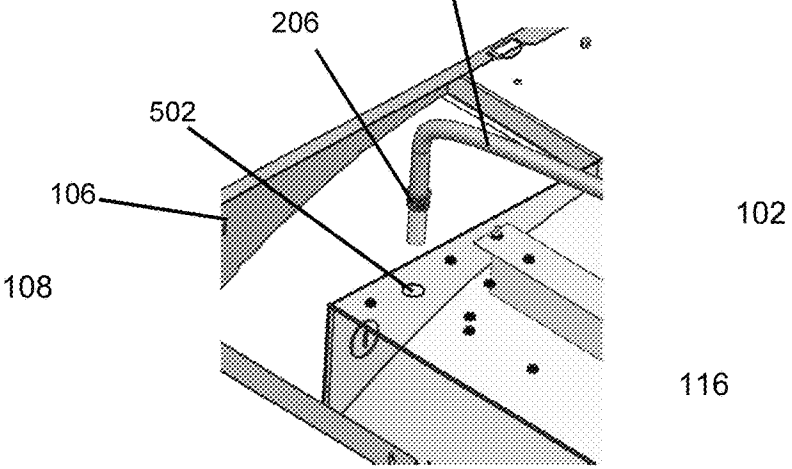
FIG. 5 is a close-up view of a cable connection of the first lighting fixture of FIG. 1 according to another example embodiment.

FIG. 5 is a close-up view of a cable connection of the lighting fixture 102 of FIG. 1 according to another example embodiment. Referring to FIGS. 1, 2, and 5, in some example embodiments, the connector 206 of the cable 130 may be a strain relief connector that is placed around the cable 130. For example, the strain relief connector may be placed in and through a hole 502 in the top cover 208 of the electronics compartment 108. Electrical wires at the end of the cable 130 may be connected to corresponding wires of the cable 116.

As shown in FIG. 5, the lighting fixture 102 is recessed in a ceiling 504 such that the electronics compartment 108 is positioned behind the ceiling 504. Because the electronics compartment 108 is positioned behind the ceiling 504, the cable 130 can be routed between the lighting fixtures 102 and 104 behind the ceiling 504 and hidden from view from below the ceiling 504. In general, the housing 106 may be recessed in the ceiling 504 such that the housing 106 is positioned entirely or mostly behind the ceiling 504. In general, the lighting fixture 102 may be recessed as shown in FIG. 5 or in a similar manner in the other embodiments of the lighting fixture 102 described herein.

Figure 6:
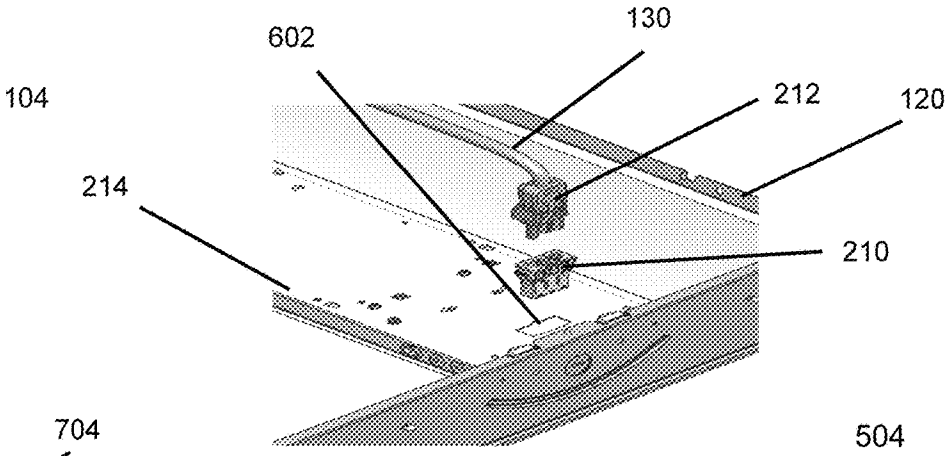
FIG. 6 is a close-up view of a cable connection of the second lighting fixture of FIG. 1 according to an example embodiment.

FIG. 6 is a close-up view of a cable connection of the lighting fixture 104 of FIG. 1 according to an example embodiment. Referring to FIGS. 1, 2, and 6, in some example embodiments, the connector 210 may be positioned in an opening 602 in the back panel 214 of housing 120 of the second lighting fixture 104. For example, the connector 210 may be a Stucchi connector that receives the mating connector 212 of the cable 130.

As shown in FIG. 6, the lighting fixture 104 is recessed in the ceiling 504 such that the pack panel 214 is positioned behind the ceiling 504. Because the pack panel 214 is positioned behind the ceiling 504, the cable 130 can be routed between the lighting fixtures 102 and 104 behind the ceiling 504 and hidden from view from below the ceiling 504. In general, the housing 120 of the lighting fixture 104 may be recessed in the ceiling 504 such that the housing 120 is positioned entirely or mostly behind the ceiling 504. In general, the lighting fixture 104 may be recessed as shown in FIG. 6 or in a similar manner in the other embodiments of the lighting fixture 104 described herein.

Figure 7:
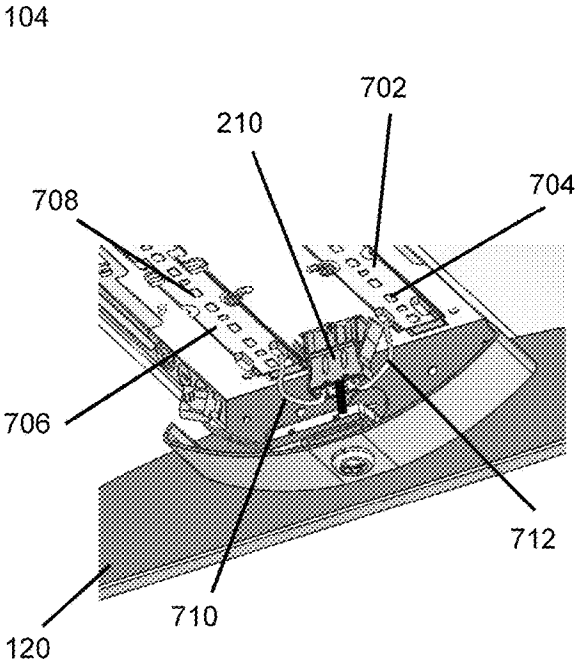
FIG. 7 is another close-up view of a cable connection of the second lighting fixture of FIG. 1 according to an example embodiment.

FIG. 7 is another close-up view of a cable connection of the lighting fixture 104 of FIG. 1 according to an example embodiment. Referring to FIGS. 1, 2, 6, and 7, in some example embodiments, the connector 210 is positioned in the hole 602 such that a portion of the connector 210 is below the back panel 214. An electrical wire 710 that is connected to a terminal of the connector 210 is connected to a circuit board 706 of the light source 122 that includes LEDs 708. An electrical wire 712 that is connected to a terminal of the connector 210 is connected a circuit board 702 of the light source 122 that includes LEDs 704. In some alternative embodiments, the connectors 210, 212 may be a different type of connectors than shown. For example, the connectors 210, 212 may be RJ45 connectors.

Figure 8:
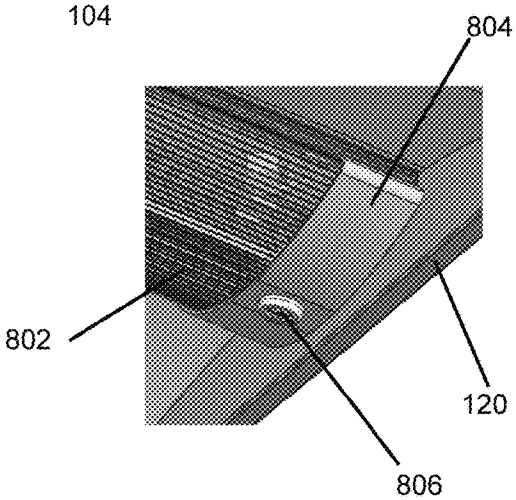
FIG. 8 is a close-up view of a sensor of the lighting fixture of FIG. 1 including a lens according to another example embodiment.

FIG. 8 is a close-up view of a sensor 806 of the lighting fixture 104 of FIG. 1 including a lens 802 according to another example embodiment. Referring to FIGS. 1, 2, 6, and 7, in some example embodiments, the lighting fixture 104 includes the sensor 806 that is attached to a cover 804. For example, the cover 804 may be attached to an end panel of the housing 120 below the lens 802 that covers the circuit boards 704, 706 of the light source 122. The sensor 806 may receive power from the driver 114 and/or may provide a status signal to the driver 114 via the cable 130.

Figure 9:
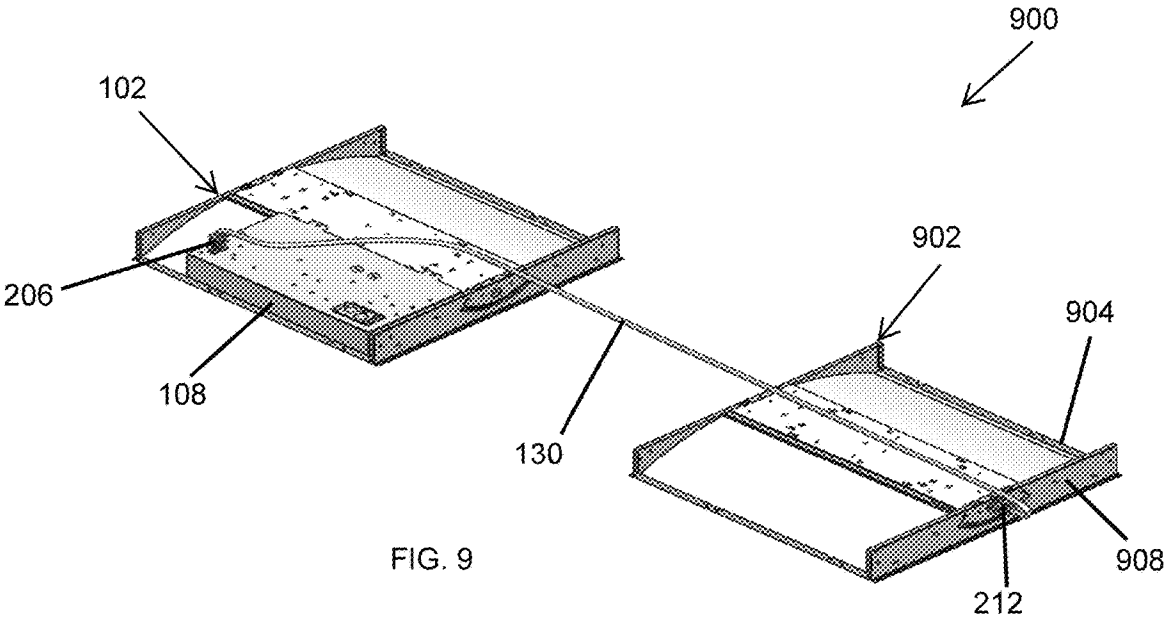
FIG. 9 illustrates a top perspective view of a system of lighting fixtures that share a driver according to another example embodiment.
Figure 10:
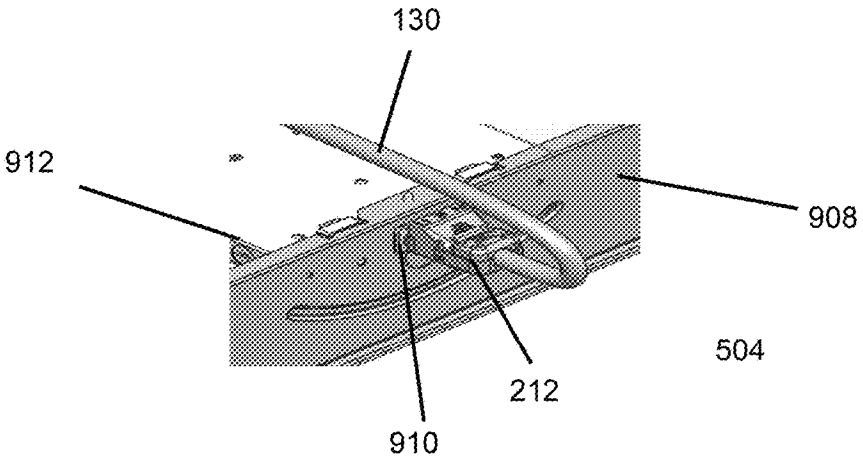
FIG. 10 is a close-up view of a cable connection of a lighting fixture that receives power from a driver in another lighting fixture of the system of FIG. 9 according to an example embodiment.

FIG. 9 illustrates a top perspective view of a system 900 of lighting fixtures that share a driver according to another example embodiment, and FIG. 10 is a close-up view of a cable connection of a lighting fixture 902 that receives power from the driver at the lighting fixture 102 of the system 900 of FIG. 9 according to an example embodiment. In some example embodiments, the lighting fixture 102 may include the driver 114 in the electronics compartment 108 as shown in FIG. 1. The cable 130 that includes the connector 206 is connected to the first lighting fixture 102 in the same manner as described above.

In contrast to the system 100 of FIGS. 1 and 2, in the system 900, the connector 212 of the cable 130 may be connected to a connector 910 at an end panel 908 of a housing 904 of the lighting fixture 902 instead of at a back panel 912 of the housing 904. For example, the connector 910 may be positioned in a hole in the end panel 908 such that one or more wires extend between the connector 910 and the circuit boards of the light source of the lighting fixture. One or more wires may also extend between the connector 910 and a sensor or another component that may be included in the lighting fixture 902. In some alternative embodiments, the connectors may be other types of connectors, such RJ45 connectors.

As shown in FIG. 10, the lighting fixture 902 is recessed in a ceiling 504 such that the electronics compartment 108 is positioned behind the ceiling 504. Because the end panel 908 of the housing 904 is positioned behind the ceiling 504, the cable 130 can be routed between the lighting fixtures 102 and 902 behind the ceiling 504 and hidden from view from below the ceiling 504. In general, the housing 904 may be recessed in the ceiling 504 such that the housing 904 is positioned entirely or mostly behind the ceiling 504. In general, the lighting fixture 902 may be recessed as shown in FIG. 10 or in a similar manner in the other embodiments of the lighting fixture 902 described herein.

In some example embodiments, the lighting fixture 102 and the lighting fixture 902 may be located in different rooms from each other.

Figure 11:
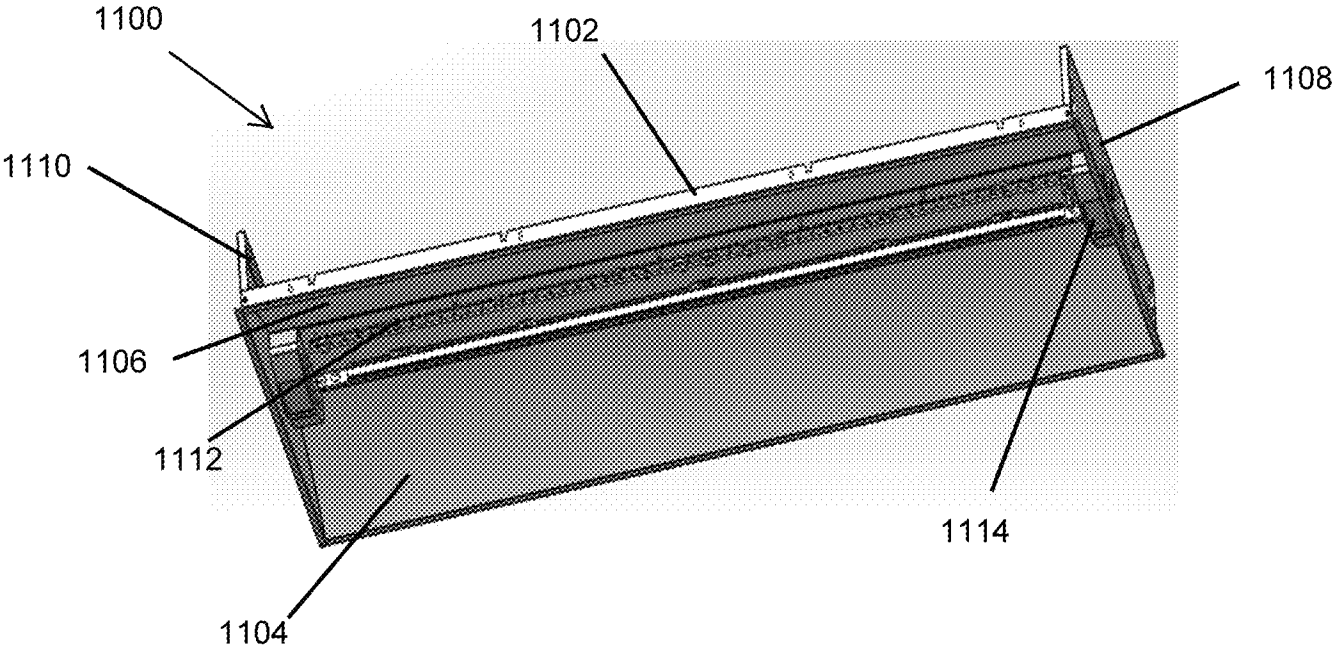
FIG. 11 illustrates a bottom perspective view of a lighting fixture that has an ambient side driver according to an example embodiment.

FIG. 11 illustrates a bottom perspective view of a lighting fixture 1100 that has an ambient side driver according to an example embodiment. As used herein, the ambient side of the lighting fixture 1100 refers to the side of the lighting fixture 1100 that faces an area below the lighting fixture 1100 when the lighting fixture 1100 is installed in a ceiling. In some example embodiments, the lighting fixture 1100 includes a housing 1102 including back covers 1104, 1106 and end panels 1108, 1110. The lighting fixture 1100 further includes a light source 1112 that is attached to a back panel of the housing 1102 on the ambient side of the lighting fixture 1100. In some example embodiments, the lighting fixture 1100 may be a recessed lighting fixture that is installed in a ceiling such as the ceiling 504.

In some example embodiments, the lighting fixture 1100 includes a driver assembly 1114 that includes a driver that provides power to the light source 1112 and other devices, such as sensors, etc., which may be integrated with the lighting fixture 1100. As illustrated in FIG. 11, the driver assembly 1114 can be positioned on the ambient side of the lighting fixture 1100 instead of the back side of the lighting fixture 1100. For example, by placing the driver assembly 1114 on the ambient side, an electronics compartment that is typically located on the back side of lighting fixtures can be eliminated.

After the lighting fixture 1100 is installed, for example, in a ceiling, the air temperature on the ambient side of the lighting fixture 1100 is generally better controlled than the temperature on the back side of the lighting fixture 1100. Placing the driver assembly 1114, including the driver, on the ambient side of the lighting fixture 1100 can reduce the negative impact (e.g., reduced efficiency, reduced life, etc.) of higher temperature on the driver.

Figure 12:
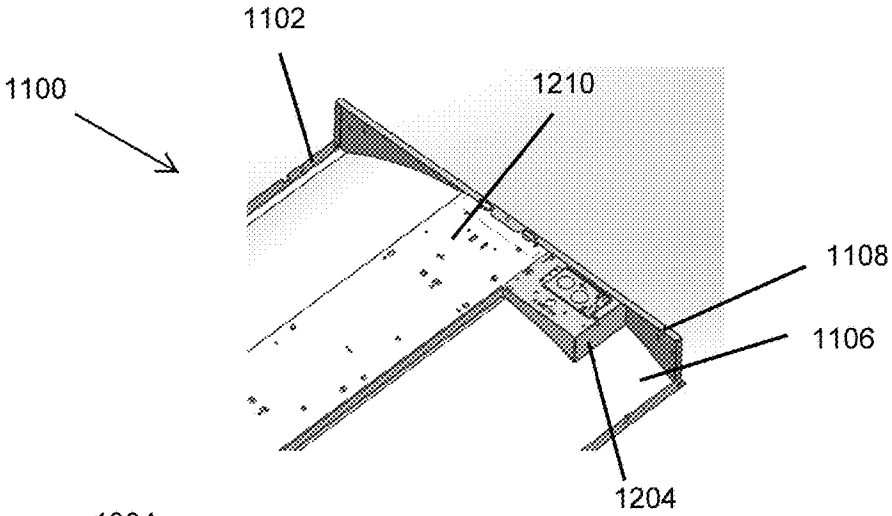
FIG. 12 illustrates a partial view of a lighting fixture with an access box on a plenum side and a driver on an ambient side of the lighting fixture according to an example embodiment.
Figure 13:
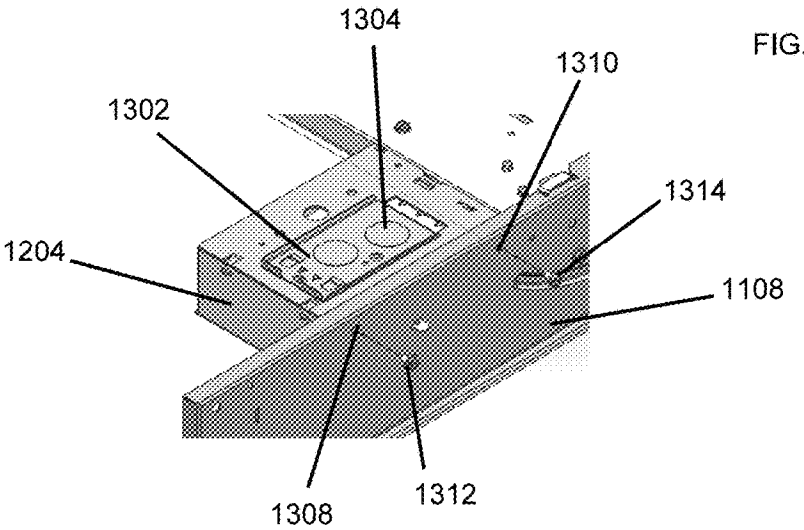
FIG. 13 illustrates a close-up view of the access box of the lighting fixture of FIG. 11 according to an example embodiment.
Figure 14:
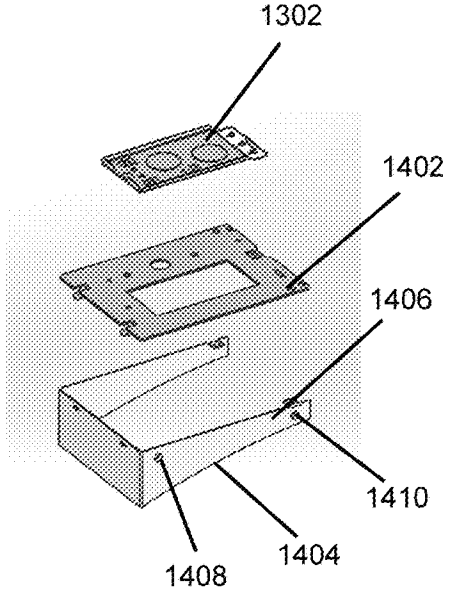
FIG. 14 illustrates an exploded view of the access box of the lighting fixture of FIG. 11 according to an example embodiment.

FIG. 12 illustrates a partial top perspective view of the lighting fixture 1100 of FIG. 11 with an access box 1204 disposed on the plenum side (i.e., back side) of the lighting fixture 1100 according to an example embodiment, and FIG. 13 illustrates a close-up view of the access box 1204 of the lighting fixture 1100 of FIG. 11 according to an example embodiment. FIG. 14 illustrates an exploded view of the access box 1204 of the lighting fixture 1100 of FIG. 11 according to an example embodiment. Referring to FIGS. 11-14, in some example embodiments, the access box 1204 provides a cavity for wiring the driver as well as for accessing the wiring of the driver from the back side of the lighting fixture 1100. For example, the access box 1204 may be positioned on the back cover 1106 of the housing 1102 and may include a door structure 1302 that is formed in a top cover 1402 of the access box 1204 and that can be opened to perform and access the wiring of the driver that is on the ambient side of the lighting fixture 1100. The access box 1204 may also include knockout sections that can be removed to route electrical wires (e.g., electrical wires for providing AC power to the driver) into the access box 1204.

In some example embodiments, the access box 1204 may be positioned against a back panel 1210 of the housing 1102. The access box 1204 may also be securely attached to the end panel 1108. For example, a frame 1404 of the access box 1204 may include holes 1408, 1410 that are lined up with holes 1308, 1310 in the end panel 1108 such that the fasteners 1312, 1314 can be used to securely attach the access box 1204 to the end panel 1108.

In contrast to an electronics compartment (e.g., the electronics compartment 108 shown in FIG. 2) that typically is large to accommodate a driver, the access box 1204 significantly smaller in size. In some alternative embodiments, the access box 1204 may be positioned at a different location than shown without departing from the scope of this disclosure. In some alternative embodiments, the access box 1204 may have a different shape than shown without departing from the scope of this disclosure. In some alternative embodiments, the access box 1204 may be omitted, for example, when using an open frame driver in the driver assembly 1114.

Figure 15:
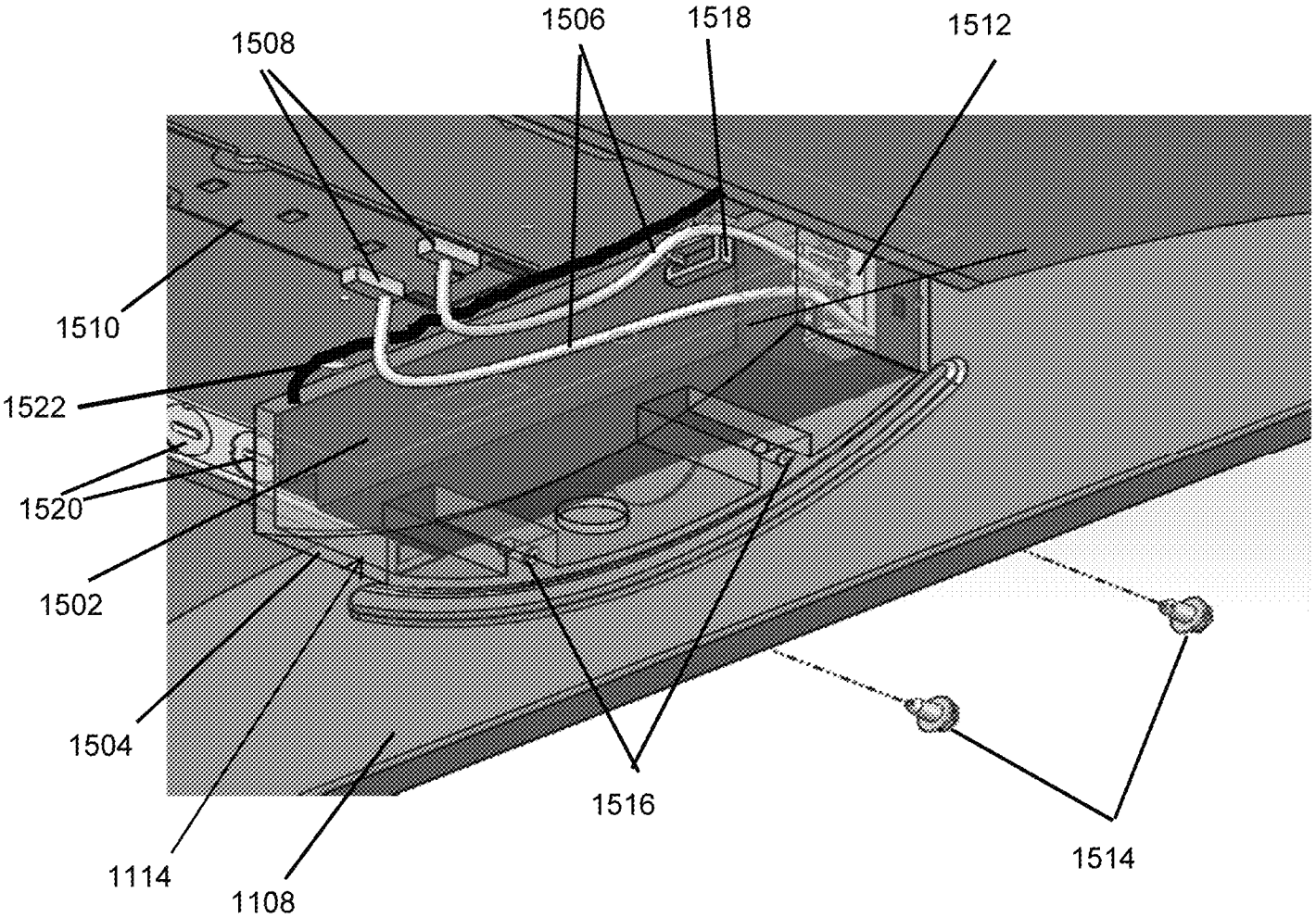
FIG. 15 illustrates a close-up view of the lighting fixture of FIG. 11 showing a driver of the lighting fixture according to an example embodiment.

FIG. 15 illustrates a close-up view of the lighting fixture 1100 of FIG. 11 showing a driver 1502 of the lighting fixture according to an example embodiment. Referring to FIGS. 11-15, in some example embodiments, the driver assembly 1114 includes the driver 1502 and the driver housing 1504 that houses the driver 1502. Electrical wires 1506 connected to terminals 1512 of the driver 1502 are routed to a circuit board 1510 of the light source (e.g., an LED light source) of the lighting fixture 1100. For example, the wires 1506 may be terminated at or by connectors 1508 that are coupled to the circuit board 1510. The driver 1502 may provide DC power to the light source of the lighting fixture 1100 including the circuit board 1510 via the electrical wires 1506. The driver 1502 may receive AC power via one or more electrical wires routed through one or more openings in the housing 1102 covered by the access box 1204.

In some example embodiments, the driver housing 1504 is attached to the end panel 1108 on the ambient side of the lighting fixture 1100. For example, the driver housing 1504 may include holes 1516, and fasteners 1514 may be used to securely attach the driver housing 1504 to the end panel 1108 through holes in the end panel 1108 and the holes 1516. In some example embodiments, a retainer structure 1518 may be attached to the back cover 1210 of the housing 1102 and may retain the driver assembly 1114 in place.

In some example embodiments, one or more knockouts 1520 in one or more of the back covers 1104, 1106, and/or the back panel 1210 may be removed to provide one or more openings to route one or more electrical wires 1522 that carry AC power to the driver 1502. For example, the access box 1204 may cover the one or more knockouts 1520 such that the one or more electrical wires 1522 can be connected inside the access box 1204 to electrical wires that carry the AC power to the lighting fixture 1100. In some example embodiments, the one or more electrical wires 1522 are continuous segments of one or more electrical wires that carry the AC power to the lighting fixture 1100. In some example embodiments, the knockouts 1520 or other openings for routing electrical wires to the driver 1502 from the back side of the lighting fixture 1100 may be at different locations than shown without departing from the scope of this disclosure.

In some example embodiments, the driver housing 1504 provides a cover structure that meets UL requirements with respect to the driver 1502. In some example embodiments, the driver housing 1504 may be made from plastic or a metal.

Figure 16:
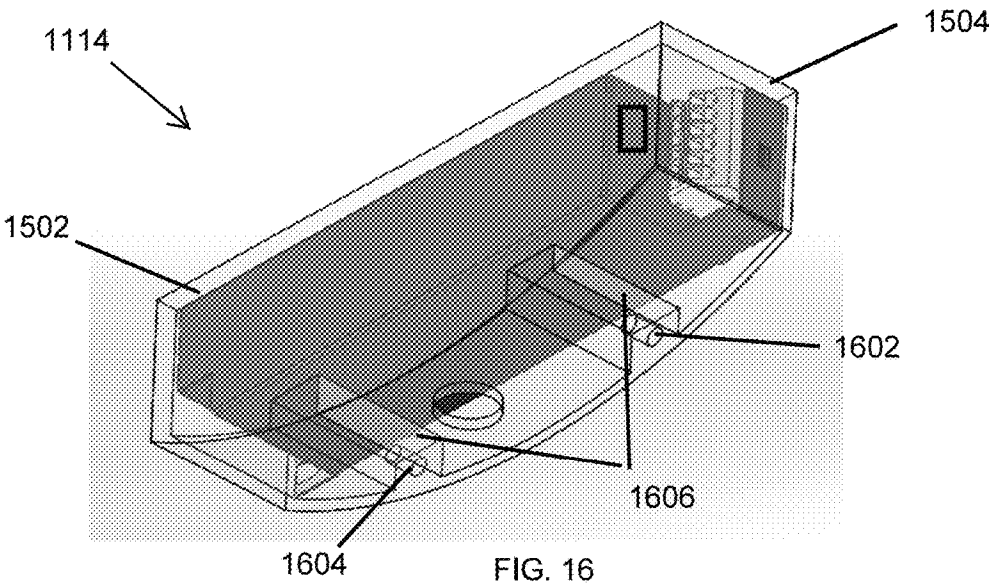
FIG. 16 illustrates the driver of the lighting fixture of FIG. 11 in the driver housing according to an example embodiment.
Figure 17:
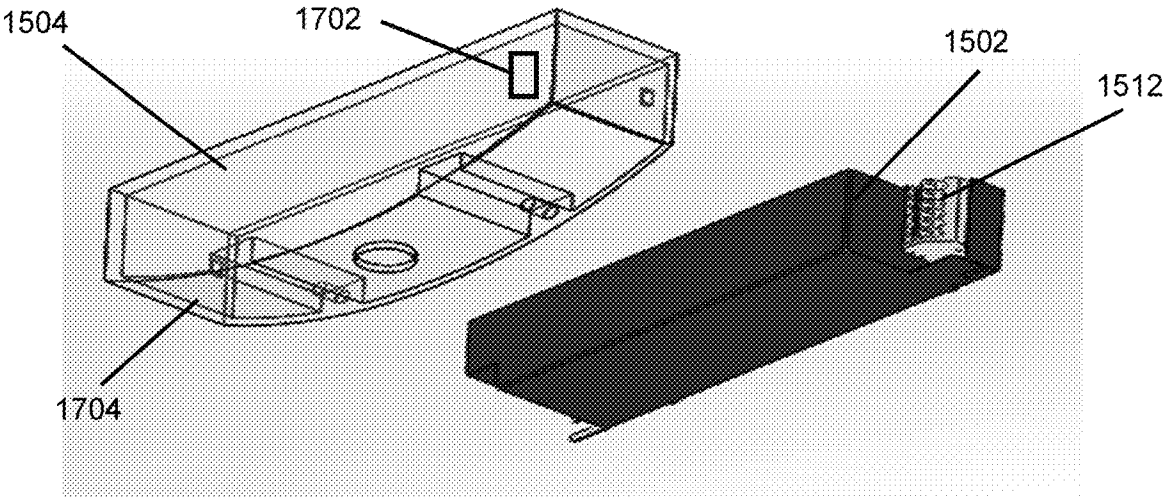
FIG. 17 illustrates the driver of the lighting fixture of FIG. 11 outside of the driver housing according to an example embodiment.

FIG. 16 illustrates the driver 1502 of the lighting fixture 1100 of FIG. 11 in the driver housing 1504 according to an example embodiment, and FIG. 17 illustrates the driver 1502 outside of the driver housing 1504 according to an example embodiment. Referring to FIGS. 11-17, in some example embodiments, the driver 1502 may be placed inside the driver housing 1504 through a top opening of the driver housing 1504. For example, the driver housing 1504 may be a molded cover that has a top opening for placing the driver 1502 inside the driver housing 1504.

In some example embodiments, the driver housing 1504 may include an opening 1702 for routing the wires 1506 from the terminals 1512 to the circuit board 1510. The driver housing 1504 may also include channels 1606 on a bottom wall 1704 of the driver housing 1504. The channels 1606 may allow the fasteners 1514 to extend through the openings 1604, 1606 in the back wall of the driver housing 1504 to secure the driver housing 1504 to the end panel 1108.

In some alternative embodiments, the driver 1502 and/or the driver housing 1504 may have a different shape than shown without departing from the scope of this disclosure. In some alternative embodiments, the driver housing 1504 may be secured to the housing 1102 of the lighting fixture 1100 in a different manner than shown without departing from the scope of this disclosure.

Figure 18:
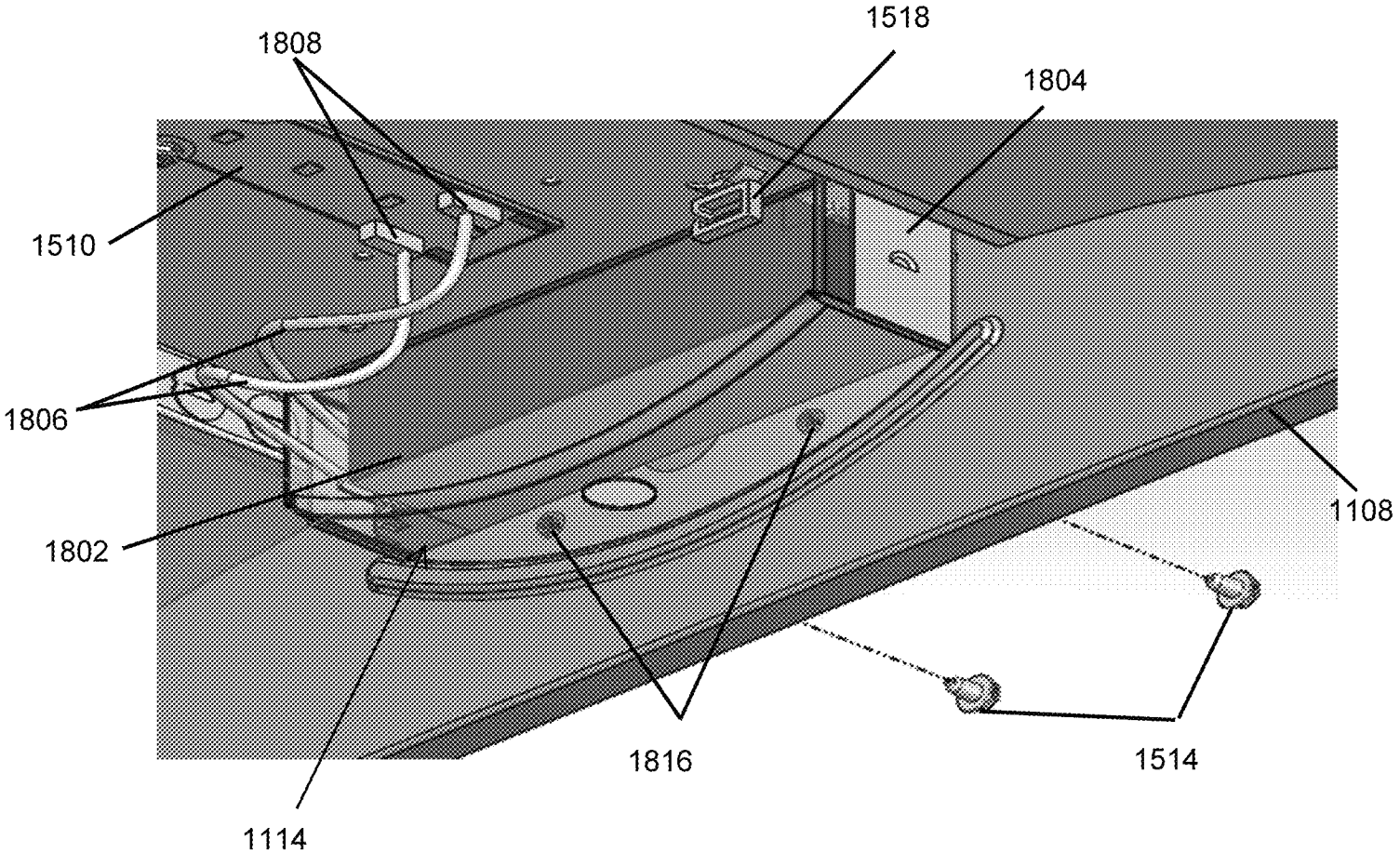
FIG. 18 illustrates a close-up view of the lighting fixture of FIG. 11 showing the driver assembly according to another example embodiment.
Figure 19:
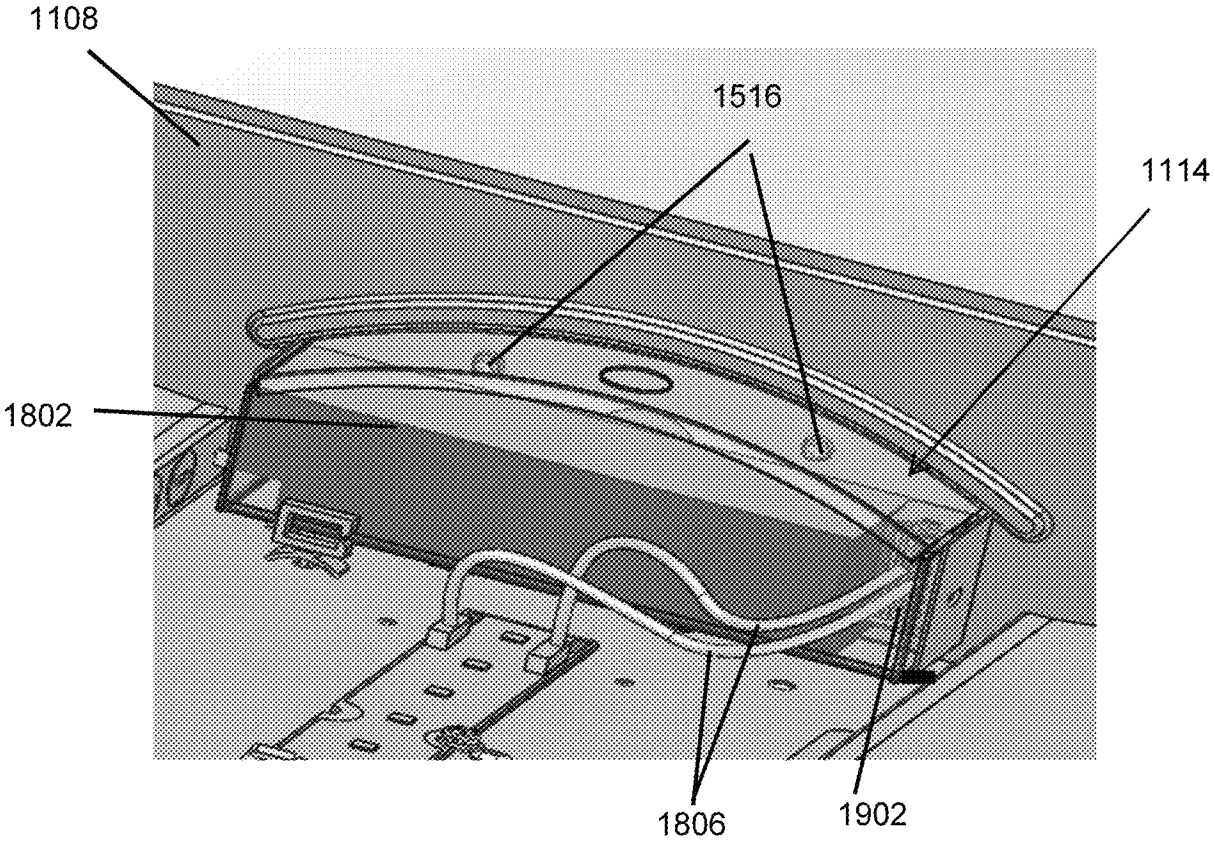
FIG. 19 illustrates another close-up view of the lighting fixture of FIG. 11 showing the driver assembly according to another example embodiment.

FIG. 18 illustrates a close-up view of the lighting fixture 1110 of FIG. 11 showing the driver assembly 1114 according to another example embodiment, and FIG. 19 illustrates another close-up view of the lighting fixture of FIG. 11 showing the driver assembly according to another example embodiment. Referring to FIGS. 11-14, 18, and 19, in some example embodiments, the driver assembly 1114 includes the driver 1802 and the driver housing 1804 that houses the driver 1802. Electrical wires 1806 connected to terminals 1902 of the driver 1802 are routed to the circuit board 1510 of the light source (e.g., an LED light source) of the lighting fixture 1100. For example, the wires 1806 may be terminated at or by connectors 1808 that are coupled to the circuit board 1510.

In some example embodiments, the driver housing 1804 is attached to the end panel 1108 on the ambient side of the lighting fixture 1100. For example, the driver housing 1804 may include holes 1816, and fasteners 1514 may be used to securely attach the driver housing 1804 to the end panel 1108 through holes in the end panel 1108 and the holes 1816. In some example embodiments, the retainer structure 1518 may be attached to the back cover 1210 of the housing 1102 and may prevent the driver assembly 1114 in place.

The driver 1802 may provide DC power to the light source of the lighting fixture 1100 including the circuit board 1510 via the electrical wires 1806. The driver 1802 may receive AC power via one or more electrical wires routed through one or more openings of the housing 1102 covered by the access box 1204.

In some example embodiments, the driver housing 1804 provides a cover structure that meets UL requirements with respect to the driver 1802. In some example embodiments, the driver housing 1804 may be made from plastic or a metal.

Figure 20:
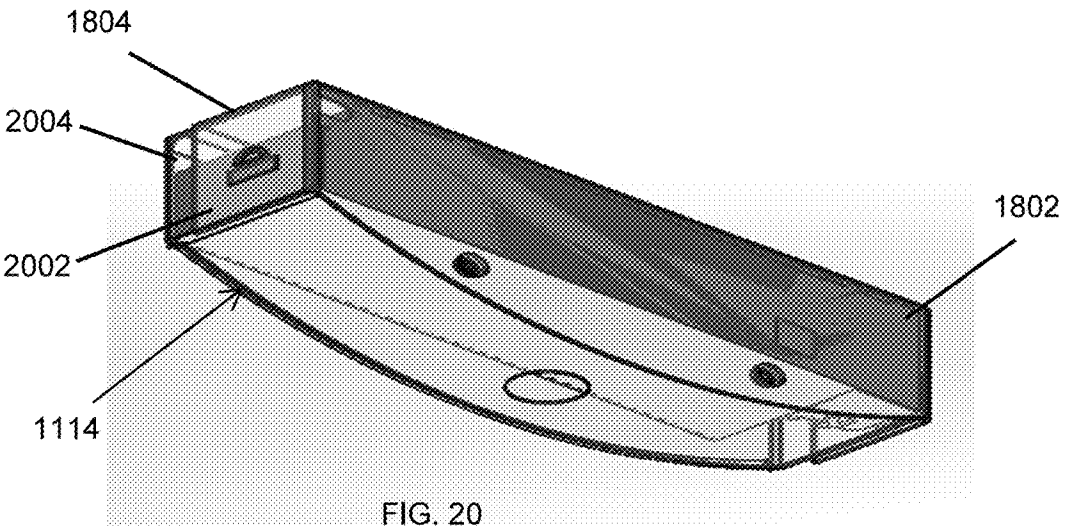
FIG. 20 illustrates the driver of the lighting fixture of FIG. 11 inside the driver housing according to an example embodiment.
Figure 21:
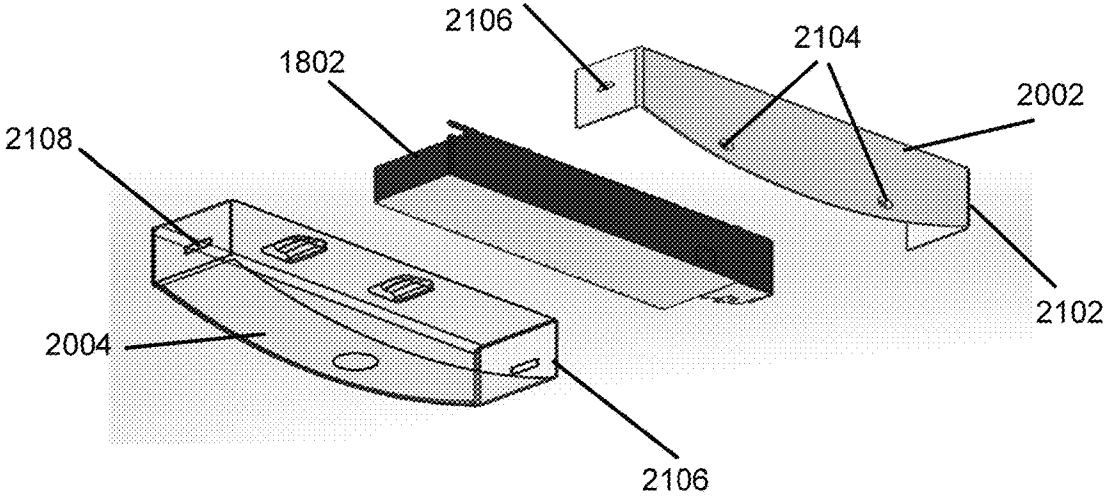
FIG. 21 illustrates the driver outside of the driver housing according to an example embodiment.

FIG. 20 illustrates the driver 1802 of the lighting fixture 1100 of FIG. 11 inside the driver housing 1804 according to an example embodiment, and FIG. 21 illustrates the driver 1802 outside of the driver housing 1804 according to an example embodiment. Referring to FIGS. 11-14 and 18-20, in some example embodiments, the driver housing 1804 may include a cover structure 2002 and a cavity structure 2004 that are assembled to form the driver housing 1804. Holes 2104 formed through the cover structure 2002 may be used to securely attach the driver assembly 1804 to the end panel 1108 of the housing 1102 of the lighting fixture 1100 using fasteners 1514.

In some example embodiments, the driver 1802 may be placed in the cavity of the cavity structure 2004, and the cover structure 2002 may be securely attached to the cavity structure using tabs 2108 of the cavity structure 2004 that lock into slots 2106 in the cover structure 2002.

In some alternative embodiments, the driver 1802 and/or the driver housing 1804 may have a different shape than shown without departing from the scope of this disclosure. In some alternative embodiments, the driver housing 1804 may be secured to the housing 1102 of the lighting fixture 1100 in a different manner than shown without departing from the scope of this disclosure. In some alternative embodiments, the driver 1802 may be an open frame driver.

Figure 22:
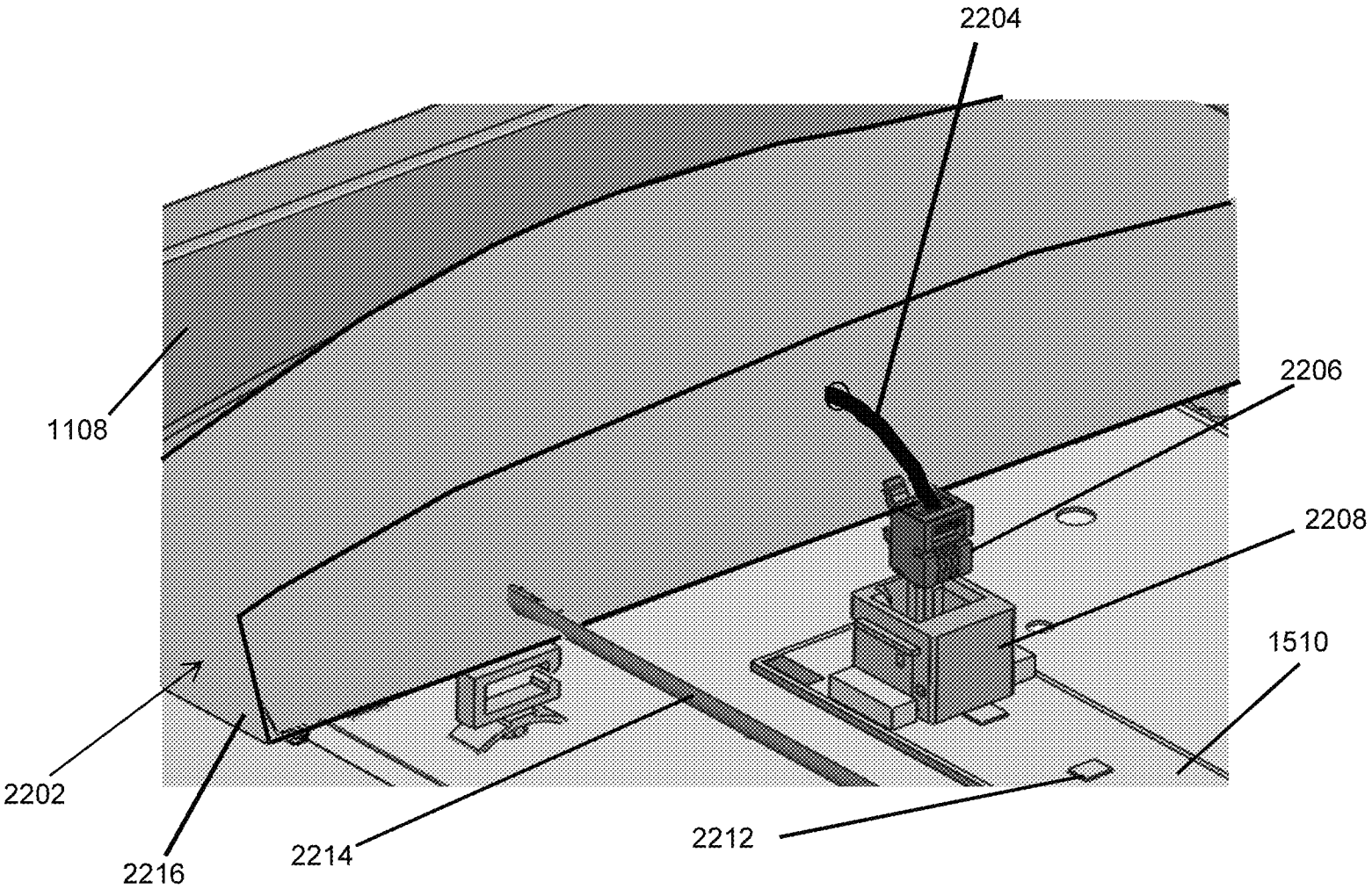
FIG. 22 illustrates a close-up view of the lighting fixture of FIG. 11 showing a driver of the lighting fixture according to another example embodiment.

FIG. 22 illustrates a close-up view of the lighting fixture 1100 of FIG. 11 showing a driver assembly 2202 according to another example embodiment. Referring to FIGS. 11-14 and 22, in some example embodiments, the driver assembly 2202 may correspond to the driver assembly 1114 shown in FIG. 11. As shown in FIG. 22, an electrical cable 2204 that is connected to a driver of the driver assembly 2202 is terminated by a connector 2206. For example, the connector 2206 may be an RJ45 plug. In some example embodiments, a connector 2208 may be coupled to a circuit board 1510 of the light source of the lighting fixture 1100. For example, LEDs 2212 of the light source may be coupled to the circuit board 1510. The connector 2208 may be an RJ45 socket that is electrically coupled to the circuit board 1510. The driver of the driver assembly 2202 provides power to the LEDs 2212 when the connector 2206 is plugged into the connector 2208.

In some example embodiments, the driver assembly 2202, which includes a driver (e.g., the driver 1502) and a driver housing 2216 that houses the driver, may be attached to the end panel 1108 in a similar manner as described above with respect to the driver assembly 1114. In some example embodiments, one or more electrical cables 2214 may be routed from the driver inside the driver housing 2216 to one or more devices (e.g., a sensor) that is integrated with the lighting fixture 1100 or to another light source of the lighting fixture 1100. For example, the driver housing 2216 may include openings that allow electrical wires/cables such as the electrical cable 2204 and the one or more electrical cables 2214 to be routed to/from the driver inside the driver housing 2216.

In some alternative embodiments, the driver 2202 and/or the driver housing 2216 may have a different shape than shown without departing from the scope of this disclosure. In some alternative embodiments, one or more of the electrical cables may exit the driver housing 2216 at different locations than shown without departing from the scope of this disclosure.

Figure 23:
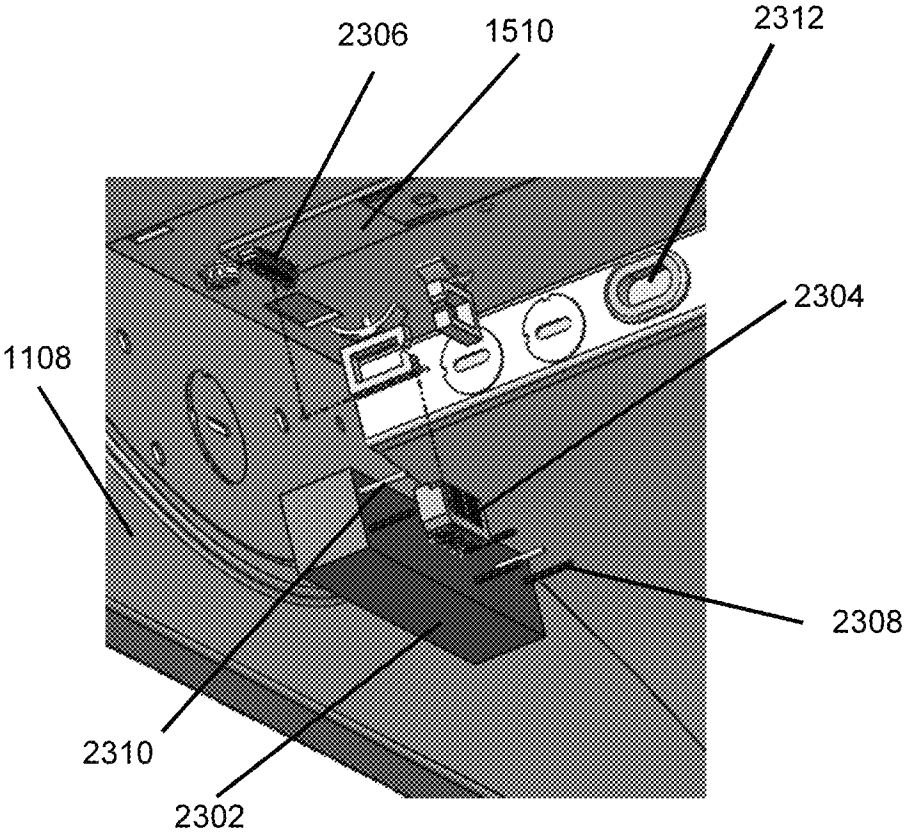
FIG. 23 illustrates a close-up view of the lighting fixture of FIG. 11 showing a driver of the lighting fixture according to another example embodiment.

FIG. 23 illustrates a close-up view of the lighting fixture 1100 of FIG. 11 showing a driver 2302 of the lighting fixture according to another example embodiment. Referring to FIGS. 11-14 and 23, in some example embodiments, the driver 2302 may include a connector 2304 that is designed to mate with a connector 2306 that is coupled to the circuit board 1510 of the light source of the lighting fixture 1100. The driver 2302 may provide power to the light source of the lighting fixture 1100 via the connectors 2304, 2306.

In some example embodiments, one or more electrical wires 2308 may be used to provide AC power to the driver 2302, and one or more electrical wires 2310 may be used to provide DC power from the driver 2302 to one or more devices (e.g., a sensor) that is integrated with the lighting fixture 1100 or to another light source of the lighting fixture 1100. For example, the one or more electrical wires 2308 may be connected to one or more electrical wires that are routed through an opening 2312 to the inside of the access box 1204 more clearly shown in FIG. 12.

Although lighting fixtures of a particular type are shown in the figures, the above description may be applicable to other types of lighting fixtures. Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A driver-less recessed lighting fixture, comprising:

a housing designed to be recessed in a ceiling when the driver-less recessed lighting fixture is installed in the ceiling, wherein the housing comprises a first end panel, a second end panel, a back panel extending between the first end panel and the second end panel;

a light source positioned on an ambient side of the housing to provide an illumination light to an area, wherein the light source is attached to the back panel; and a connector configured to be coupled to an electrical cable that carries power to the driver-less recessed lighting fixture from a driver of a second recessed lighting fixture, wherein the connector is attached to the first end panel, wherein the light source is electrically coupled to the connector to receive the power from the driver of the second recessed lighting fixture via the connector and the electrical cable, wherein the driver-less recessed lighting fixture does not include a light source driver to provide an electrical power to the light source, and wherein the connector is positioned to be hidden from view from below the ceiling when the driver-less recessed lighting fixture is installed in the ceiling.

2. The driver-less recessed lighting fixture of claim 1, further comprising a sensor that operates based on the power from the driver of the second recessed lighting fixture.

3. The driver-less recessed lighting fixture of claim 1, further comprising a sensor positioned on the ambient side of the housing and configured to send a detection status signal to the second recessed lighting fixture via the connector.

4. The driver-less recessed lighting fixture of claim 1, wherein the connector is attached to a back panel of the housing that is positioned behind the ceiling when the driver-less recessed lighting fixture is installed in the ceiling.

5. The driver-less recessed lighting fixture of claim 1, wherein the connector is located at an end panel of the recessed lighting fixture such that the end panel is recessed in the ceiling when the driver-less recessed lighting fixture is installed in the ceiling.

6. The driver-less recessed lighting fixture of claim 1, wherein the connector is an RJ-45 connector.

7. A system of recessed lighting fixtures, comprising:

a first recessed lighting fixture comprising a housing and an electronics compartment that is attached to a back cover of the housing and positioned on a back side of the first recessed lighting fixture, the electronics compartment having a cavity to contain a driver of the first recessed lighting fixture that provides a first power to a light source of the first recessed lighting fixture, wherein the light source of the first recessed lighting fixture is configured to provide a first illumination light;

a second recessed lighting fixture, wherein a light source of the second recessed lighting fixture is configured to provide a second illumination light, wherein the second recessed lighting fixture does not include a light source driver that is configured to provide electrical power to the light source of the second recessed lighting fixture; and an electrical cable electrically connected to a connector of the first recessed lighting fixture and to a connector of the second recessed lighting fixture, wherein the driver of the first recessed lighting fixture is configured to provide a second power to the second recessed light fixture, wherein the second recessed lighting fixture is designed to receive the second power from the driver of the first recessed lighting fixture via the electrical cable and wherein the connector of the first recessed lighting fixture and the connector of the second recessed lighting fixture are positioned hidden from view from below a ceiling when the first recessed lighting fixture and the second recessed lighting fixture are installed recessed in the ceiling.

8. The system of claim 7, wherein at least a portion of the second power is provided at least to the light source of the second recessed lighting fixture.

9. The system of claim 8, wherein a second portion of the second power is provided to an Internet of things (IoT) device of the second recessed lighting fixture.

10. The system of claim 7, wherein the connector of the first recessed lighting fixture is attached to the electronics compartment of the first recessed lighting fixture.

11. The system of claim 7, wherein the connector of the second recessed lighting fixture is attached to a housing of the second recessed lighting fixture and wherein one or more electrical wires extend from the connector of the second recessed lighting fixture to the light source of the second recessed lighting fixture.

12. The system of claim 11, wherein the connector of the second recessed lighting fixture is attached to a back panel of the housing of the second recessed lighting fixture.

13. The system of claim 11, wherein the connector of the second recessed lighting fixture is located at an end panel of the second recessed lighting fixture.

14. The system of claim 7, wherein the first recessed lighting fixture is configured to receive a sensor output signal from a sensor of the second recessed lighting fixture via the electrical cable.

15. The system of claim 7, wherein the electrical cable is an Ethernet cable.

16. The system of claim 7, wherein the electrical cable is a Class 2 cable.

* * * * *